US007125312B2

(12) United States Patent
Castañares et al.

(10) Patent No.: US 7,125,312 B2
(45) Date of Patent: Oct. 24, 2006

(54) ROTOR-GRINDING MACHINE COMPRISING A ROTARY HEAD WITH TWO GRINDING WHEELS

(75) Inventors: Olatz Astigarraga Castañares, Elgoibar (ES); Singh Harvinder Chana, Leicester Forest East (GB)

(73) Assignee: Danabat, S. Coop, Elgolbar (ES)

( * ) Notice: Subject to any disclaimer, the term of this patent is extended or adjusted under 35 U.S.C. 154(b) by 124 days.

(21) Appl. No.: 10/509,406

(22) PCT Filed: Mar. 14, 2003

(86) PCT No.: PCT/ES03/00116

§ 371 (c)(1),
(2), (4) Date: Sep. 24, 2004

(87) PCT Pub. No.: WO03/080292

PCT Pub. Date: Oct. 2, 2003

(65) Prior Publication Data

US 2005/0159079 A1 Jul. 21, 2005

(30) Foreign Application Priority Data

Mar. 26, 2002 (ES) ..... 200200711

(51) Int. Cl.
*B24B 49/00* (2006.01)
*B24B 51/00* (2006.01)

(52) U.S. Cl. ..... 451/5; 451/6; 451/10; 451/21; 451/58; 451/72; 451/195; 451/246; 451/443

(58) Field of Classification Search ..... 451/5, 451/6, 8, 10, 11, 21, 22, 45, 48, 57, 58, 65, 451/72, 178, 179, 195, 236, 242, 246, 254, 451/280, 285, 290, 443; 356/4.01, 3.63
See application file for complete search history.

(56) References Cited

U.S. PATENT DOCUMENTS

| | | | | | |
|---|---|---|---|---|---|
| 2,458,840 | A | * | 1/1949 | Eklund | 451/160 |
| 4,326,804 | A | * | 4/1982 | Mossey | 356/623 |
| 4,376,357 | A | * | 3/1983 | Shackleton | 451/249 |
| 5,618,222 | A | * | 4/1997 | Baima et al. | 451/14 |
| 5,625,446 | A | * | 4/1997 | Bedard | 356/3.08 |
| 5,704,826 | A | * | 1/1998 | De Luis Vizcaino | 451/242 |

* cited by examiner

*Primary Examiner*—Timothy V. Eley
(74) *Attorney, Agent, or Firm*—Lucas Mercanti, LLP

(57) ABSTRACT

The invention relates to a machine (1) for grinding the blades of a turbine rotor (2) or a compressor. The inventive machine consists of a rotary head (6) which is provided with two different grinding wheels (7, 7') for grinding the rotors (2), three carriages (8, 9, 10) of the head which are used for the linear and angular movement thereof, a machine control unit (16) comprising a numerical control (CNC) which is used to calculate the grinding position of each grinding wheel, an optical sensor (19) which is used to measure the radius R of the blades and a device (12, 13) for the individual shaping of each grinding wheel which is supported on a carriage (14, 15) with means for the linear movement thereof (U, C) and which operates automatically during the grinding process without altering the position of the grinding wheel.

3 Claims, 2 Drawing Sheets

ROTOR-GRINDING MACHINE COMPRISING A ROTARY HEAD WITH TWO GRINDING WHEELS

BACKGROUND OF THE INVENTION

1. Field of the Invention

The present invention is related to grinding machines for turbine or impeller blades or similar.

2. Related Art

From publication U.S. Pat. No. 5,704,826, a turbine rotor blade grinding machine is known where the head has two grinding wheels with different features for grinding different rotors in view of the blade length and width. This machine avoids the substitution of a grinding wheel and having to repeat the adjusting process of the angular and linear position of the head of the new grinding wheel with respect to the new rotor, which it is necessary with the machines having a head with only one grinding wheel.

In the grinding machine described in publication U.S. Pat. No. 5,704,826, the angular and lineal displacements of the head to position the second grinding wheel are controlled by a control unit of the machine having a CNC, which calculates the coordinates of the new position starting from geometric data relative to the two grinding wheels, with the cooperation of an optical measuring system to line up the grinding wheel and measure the radius of the blade tips.

An example of an optical system to line up the grinding wheel and measure the blade radius during the grinding operation at high speed of the rotor, between 1500 r.p.m. and 3000 r.p.m., controlled by means of stroboscope is disclosed U.S. Pat. No. 4,566,225, in which the light intensity received at the sensor represents the height or radius of the blades, but here the optical sensor uses an infrared light beam.

To obtain the desired at the blade tips, the grinding wheel carries out micrometric incremental displacements of the grinding wheel head in both directions, axial and radial, with respect to the rotor during the grinding operation. The abrasion on the grinding wheel due to the use of the grinding wheel for grinding makes it necessary to compensate for the wear and to correct the irregularities of the surface of the grinding wheel by means of a shaping device. The superficial irregularities of the grinding wheel provoke the appearance of burrs at the blade tips, which affect the radius measuring of the blades, and can cause an excess of grinding.

In publication EP-0592112-A, the machine has a shaping device having a diamond roller, supported on a carriage. This machine has the inconveniences that the shaping device is separated from the grinding wheel head and situated behind the grinding wheel head. The shaping of the grinding wheel is executed once the grinding cycle of a rotor is finished, or at the interval of a grinding cycle, stopping the grinding operation, separating the head from its working position and moving the grinding wheel to the roller. After the shaping, the grinding wheel is adjusted again, and placed in contact with the blade tips to continue the grinding cycle.

SUMMARY OF THE INVENTION

The present invention solves the problems in the art by building a grinding machine that has a rotary head with two grinding wheels, each with shaping devices and controlling the grinding operations of the blade tips of a rotor, and the shaping operation of the grinding wheel at the same time during the grinding cycle of a rotor. A control unit positions the grinding wheels and the shaping devices, and an optical sensor is used to measure the blade radius.

The object of the present invention is a grinding machine for compressor or turbine rotor blades, which includes a head with two different grinding wheels, whose positioning is directed by an electronic control unit of the machine, in cooperation with an optical system to measure the radius of the blades during the grinding operation, and a shaping device associated with each grinding wheel, which can be activated automatically, in addition to previously fixed moments of the grinding cycle, during the grinding in answer to an indication from the measuring signal generated by the optical system.

The electronic control unit, in addition to controlling the angular and linear displacements of the grinding wheel head during the grinding, controls the positioning of each grinding wheel on each rotor period, by means of the calculation based on the dimensions and geometric distances of both grinding wheels. The optical system to measure the blade radius is able to detect in a continuous way the presence of burrs on the blade tips, and the control unit activates the shaping device of the grinding wheel automatically during the grinding cycle, without altering the position of the grinding wheel and its rotation, and without it being necessary for an operator to be-present. The shaping device is moved to put the shaping roller in touch with the grinding wheel. This way the grinding cycle is not interrupted, stopping only the forward movement of the grinding wheel.

DETAILED DESCRIPTION OF THE INVENTION

Figure 1:
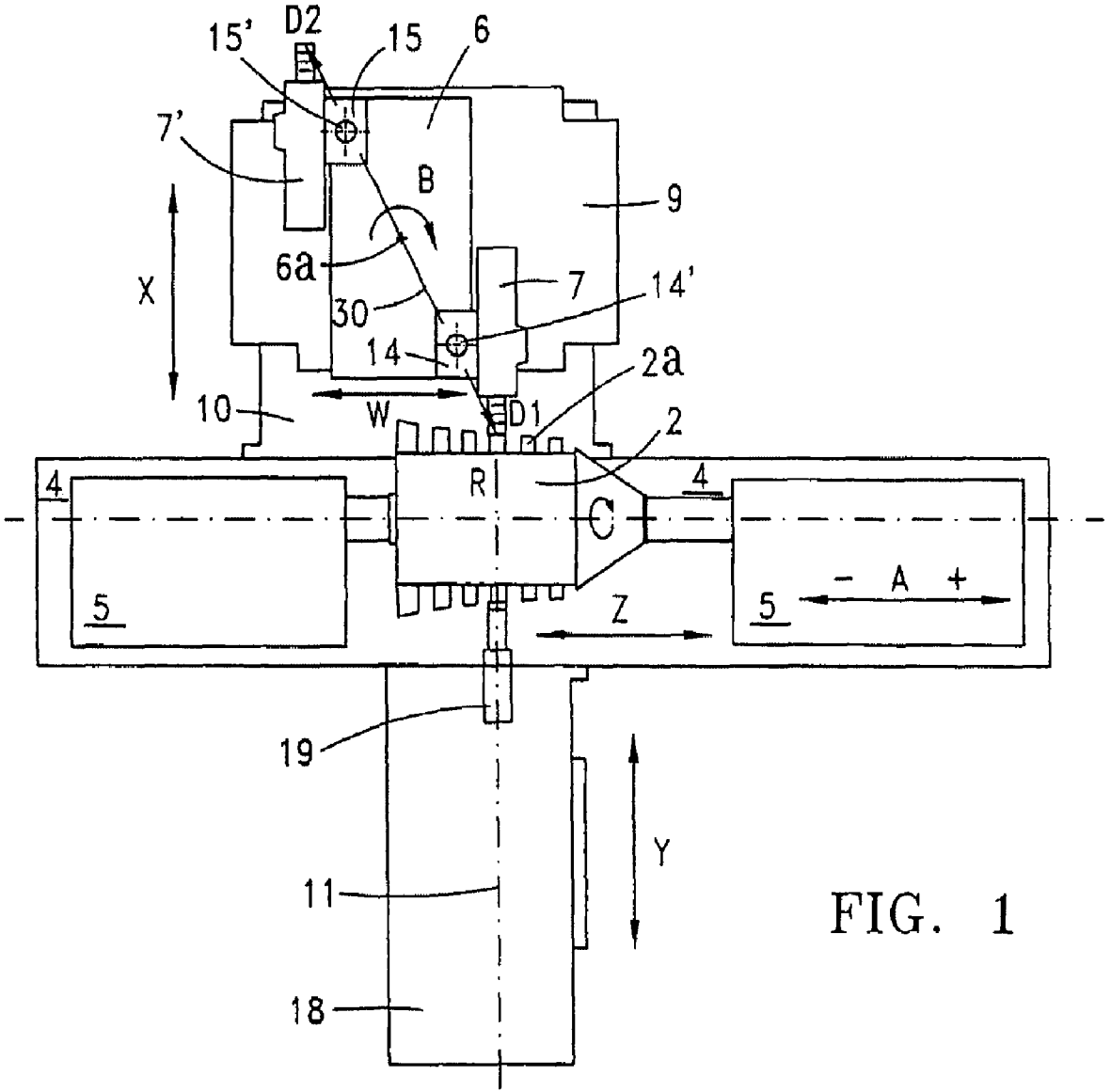
FIG. 1 is a top view of a grinding machine for a compressor rotor, showing the grinding of a rotor blades period.
Figure 2:
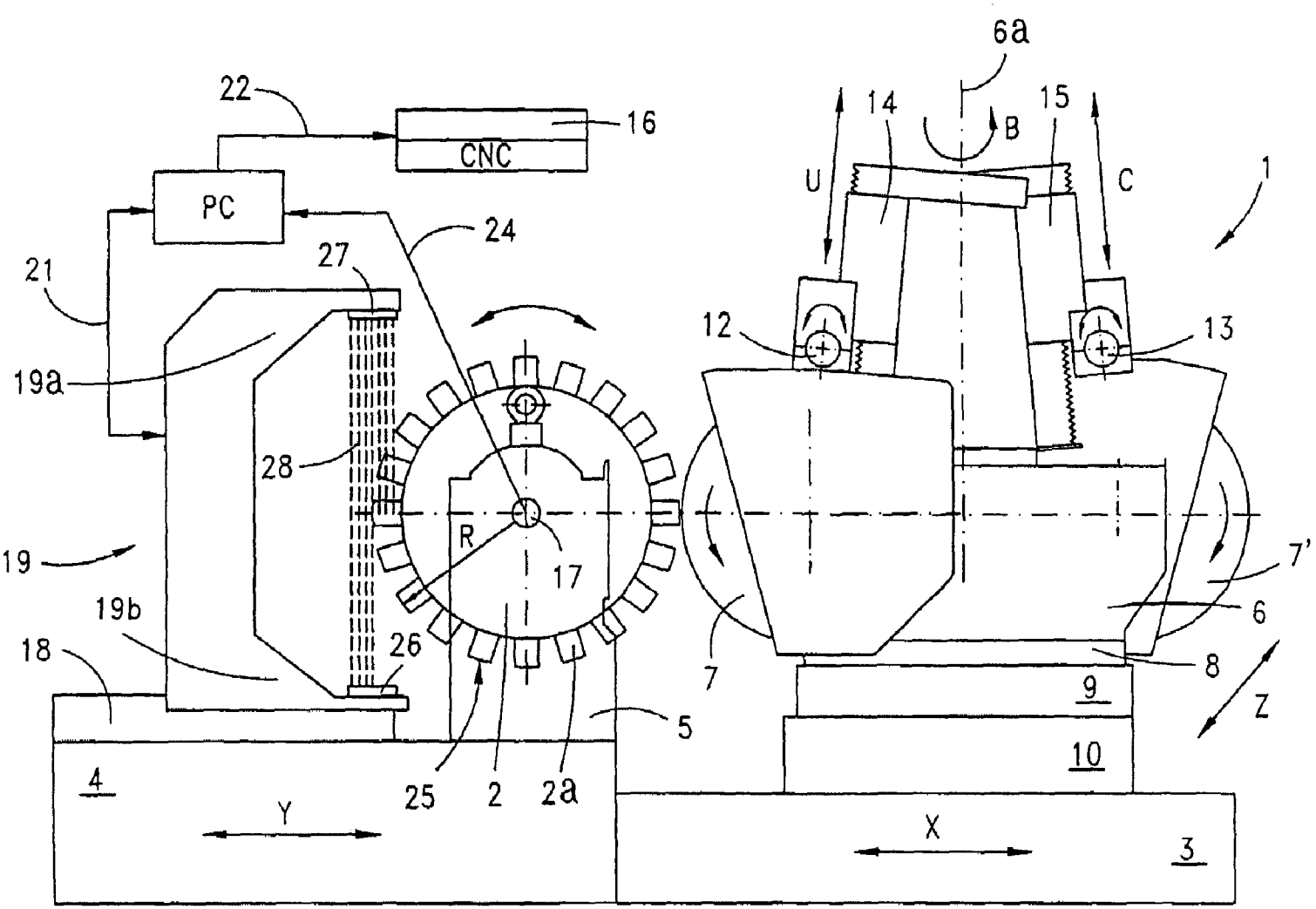
FIG. 2 is a raised view of the grinding machine of FIG. 1.

With reference to FIGS. 1–2, a preferred embodiment of a grinding machine 1 for the blades 2*a* for a turbine or a compressor rotor 2 according to the invention includes:

- a machine bench 3,
- a carriage 4 supporting two pedestals 5 supporting the rotor 2 movable in an axial direction Z of the rotor 2,
- a grinding wheel head 6 including two grinding wheels for grinding 7, 7' with different features,
- a carriage 8 for rotating the head 6 in an angular movement B around a central vertical shaft 6*a*, and
- two carriages 9, 10 to move the head in a linear movement to position it in the direction Z and to cause a forward displacement of the grinding wheel in a radial direction X of the rotor 2,
- a respective shaping device includes diamond rollers 12, 13 for each grinding wheel 7, 7' supported on an individual carriage 14, 15 associated to the grinding wheel head,
- an electronic control unit 16 including a numerical control CNC to calculate and control the movements of the carriages, and
- a system for measuring the radius R of the blades, includes an optical sensor 19 lined up according to the shaft with reference 11 (FIG. 1) with the rotor blades 2*a* on which the grinding wheel 7 is working, and a measuring instrument, such as a PC computer, which transmits a signal 22, representative of the lining up of the grinding wheel 7 or of the grinding wheel 7' and of the measure obtained of the radius R to the control unit 16.

The carriage 8 rotates the head 6*a* up to 180 degree around a central vertical shaft 6*a*, for of a grinding wheel 7 (FIGS. 1 and 2) to a second grinding wheel 7' selected for the grinding of a second rotor 2, different from the previously rectified one. An angular displacement B of the carriage is carried out for its relative inclination to the radius R of the blades, depending of the shape bend of the blade tips 25 that are being rectified.

For the positioning of the second grinding wheel 7' in touch with the blade tips 25 of a second rotor 2, the carriages 9, 10 provide the head 6 with the linear displacements in the directions Z and X, apart from the incremental movement and forward "W" displacements of the grinding wheel during the grinding. The calculation of the position of the second grinding wheel 7' is carried out by the numerical control CNC as a function of the diameters D1 and D2 of the two grinding wheels 7, 7' and the diagonal distance 30 between the surfaces of both grinding wheels 7, 71 (FIG. 1).

The shaping device includes a respective carriage 14, 15 supporting a diamond roller 12, 13, the carriage 14, 15 are incorporated on the grinding wheel head 6 to accompany a respective grinding wheel 7, 7' in its linear displacements X, Z and angular displacement B. The carriage 14, 15 are projected above the head 6, and are moved vertically with its roller 12, 13 for the shaping of its corresponding grinding wheel 7, 7', carrying out respectively a linear approaching displacement "U" or "C" from a retracted position above the grinding wheel 7 and forward movement of the roller 12, 13 during the shaping. The carriages 14, 15 include screws 14', 15' for its linear displacement governed by the control unit 16, carrying out the shaping without the grinding wheel 7, 7' having to be withdrawn from its contact position with the rotor blades 2*a* that is being rectified.

The optical sensor 19 includes a light source 26 which issues a collimated beam 28 and an electronic photo-detector 27, situated on both opposed arms 19*a*, 19*b* of a support in the shape of an arch (FIG. 2) with greater dimension than the circle of the rotor blades 2*a*. The opposed arms 19*a*, 19*b* of the sensor are situated including the rotor blades 2*a* that is being rectified. Therefore the optical sensor 19 is supported on a carriage 18, which can be moved in the axial direction "Z" to move the sensor 19 from one period of rotor blades 2*a* to another, and in a direction "Y" to carry out a radial forward movement towards the rotor blades 2*a*. The collimated beam 28 completely illuminates the blades which during their rotation pass between the source 26 and the photo-detector 27 receiving the latter an image of successive light and dark points corresponding to the light intensity corresponding to the crossing of each blade tip 25 with the beam 28. The PC computer receives an undulating electric signal 21 in each rotation, which is representative for the absolute value of the radius R. The signal 21 is not affected by the height of the blades interposed at the beam 28. The PC computer acquires and processes the signal 21 and combines it with a signal 24 of the rotation speed of the rotor 2 proceeding from an "encoder" 17 of the rotor shaft, and the resulting signal 22 is connected to a control unit 16, to control the grinding and the shaping. The alterations with respect to the values of the undulating signal 21 provoked by the burrs on the blades are detected by the control unit 16 at each moment of the grinding cycle, actuating the shaping device to cause the corresponding shaping automatically.

The invention claimed is:

1. Grinding machine for blades of a turbine or a compressor rotor, comprising:

a machine bench, supporting a rotor of several periods of blades rotating at high speed;

a grinding wheel head including two grinding wheels for grinding which are rotatable into a grinding position for the grinding of blades of successive rotors;

a shaping device associated with each grinding wheel for shaping of each grinding wheel, each shaping device including a respective shaping tool mounted on a supporting carriage for linear movement of the shaping tool with respect to the grinding wheel;

an electronic control unit including a numerical control CNC to control the rotor, displacement of the grinding wheel head in an axial direction in a radial directions and an angular direction with respect to the rotor, and displacements of the shaping device;

an optical system to measure the radius (R) of the blades the rotor period being rectified, which is connected to the bench of the machine;

the grinding wheel head is supported on a rotary carriage and two linear carriages, which carry out the displacements of the head, calculated from geometric data relative to the two grinding wheels;

wherein the optical system in cooperation with the control unit carries out a continuous detection of burrs on the blades during the grinding by means of measuring perturbations of the radius R, and each respective shaping tool carries out shaping of each respective grinding wheel during continuous detection of burrs by the optical system without stopping the grinding.

2. Grinding machine for rotor blades according to claim 1, wherein the two grinding wheels are situated ne at each side of the head and the shaping tools supported on the carriage are projected above the head and connected by screws for carrying out a vertical approaching movements to the grinding wheels and a forward movement during the shaping.

3. Grinding machine for blades according to claim 1, where the optical sensor is supported on a carriage, which moves in a direction "Y" to carry out a horizontal radial forward movement towards the blades of the rotor, and has two opposed arms, including light a issuer and receiver, which are situated covering the rotor blades.

* * * * *